United States Patent [19]

Masuda

[11] Patent Number: 4,884,316

[45] Date of Patent: Dec. 5, 1989

[54] HINGE

[75] Inventor: Yoshinori Masuda, Tokyo, Japan

[73] Assignee: Kabushiki Kaisha Murakoshi Seiko, Tokyo, Japan

[21] Appl. No.: 280,883

[22] Filed: Dec. 7, 1988

[30] Foreign Application Priority Data

Jun. 10, 1988 [JP] Japan ..... 63-76875[U]

[51] Int. Cl.[4] ..... E05F 1/14

[52] U.S. Cl. ..... 16/288; 16/289; 16/294; 16/302; 16/370; 16/382; 16/387; 16/388

[58] Field of Search ..... 16/289, 294, 302, 370, 16/382, DIG. 43, 288, 387, 388

*Primary Examiner*—Richard K. Seidel
*Assistant Examiner*—Edward A. Brown
*Attorney, Agent, or Firm*—James E. Nilles; Thomas F. Kirby

[57] ABSTRACT

A hinge consisting of a base, a rotating member mounted to one end of the base through a pair of link arms, the rotating member being supported by a spring in a closed or open condition. The base is formed out of a single piece of sheet metal by bending and shaping so as to have a pair of side plate portions to be fitted over projections of a member on which the hinge is mounted; a connecting plate portion formed integral with, and provided between, the link arm mounting sides of the pair of the side plate portions; and screw support plate portions bent inwardly from the pair of the side plate portions so that they face the projections of the member on which the hinge is mounted, the screw support plate portions being joined together to be shaped like a letter U, the joint part of the screw support plate portions being formed with screw insertion holes.

5 Claims, 3 Drawing Sheets

HINGE

BACKGROUND OF THE INVENTION

1. Field of the Invention

This invention relates to a hinge and more particularly to those used on the covers of boxes such as console boxes, glove boxes and armrests in automobiles.

2. Description of the Prior Art

A hinge, such as is disclosed by the Japanese Utility Model Laid-Open No. 28877/1986, is known in which a rotating member is mounted to one end of a base of the hinge through a pair of link arms so that the rotating member can be opened and closed, and in which the rotating member is supported stable in the open or closed condition by a spring.

A hinge of this kind that uses those link arms can maintain the open condition or closed condition by means of a spring, so that it has an advantage of not requiring a separate catch mechanism etc.

The hinge shown in the above utility Model Laid-Open has flanges, formed like a flat plate, on each side of a bottom plate of the base which is secured, through mounting holes in the flanges, to a member on which the hinge is mounted.

Since the conventional hinge has its mounting flanges projecting outwardly, it requires a large mounting space and, depending on the shape of the member on which the hinge is mounted, a sufficient mounting space may not be available.

SUMMARY OF THE INVENTION

This invention has been accomplished to make it possible to securely fix a hinge base to a small mounting portion such as a boss.

The objective of the invention can be achieved by a hinge wherein a rotating member is mounted rotatably to one end of a base through a pair of link arms characterized in that said base is formed out of a single piece of sheet metal by bending and shaping so that it comprises:

- a pair of side plate portions fitted over projections of a member on which the hinge is mounted;
- a connecting plate portion formed integral with, and provided between, the link arm mounting sides of the pair of the side plate portions;
- and screw support plate portions bent inwardly from the pair of the side plate portions so that they face the projections of the member on which the hinge is mounted, the screw support plate portions being joined together to be shaped like a letter U, the joint part of the screw support plate portions being formed with screw insertion holes.

According to the hinge of the invention, the U-shaped portion of the base which consists of the pair of side plate portions and the screw support plate portions is fitted over the projections of the member on which the hinge is to be mounted. Screws inserted from outside into the screw insertion holes of the screw support plate portions are screwed into the projections to secure the screw support plate portions. Since the two screw support plate portions are fixed to the projections at the joint part by common screws, they require a smaller number of screws than does the conventional technique.

These and other objects and features of this invention will be described in detail by referring to the attached drawings.

DESCRIPTION OF THE PREFERRED EMBODIMENT

Figure 1:
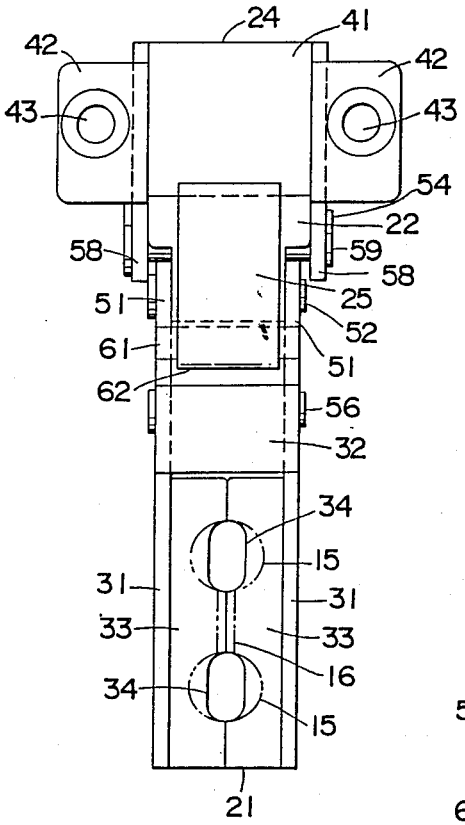
FIG. 1 is a front view of a hinge according to one embodiment of the invention.
Figure 2:
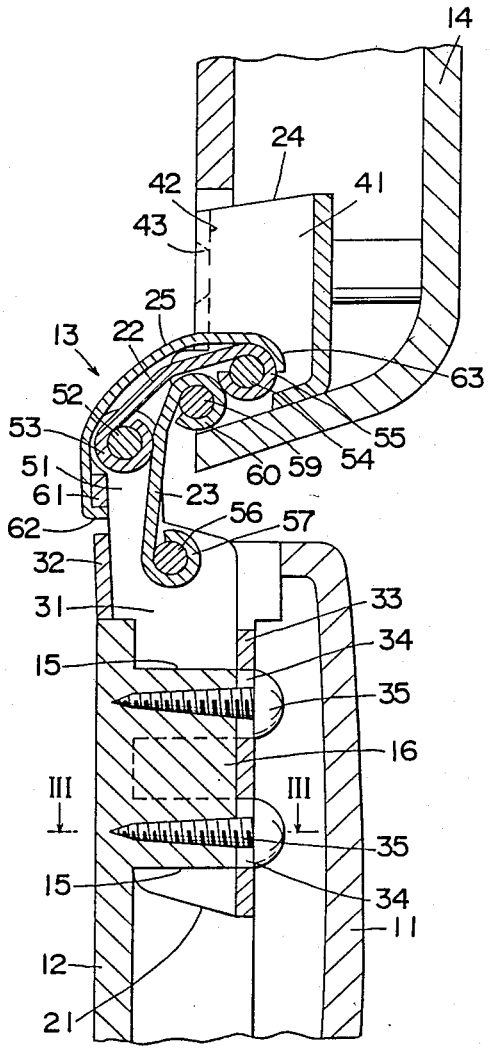
FIG. 2 is a cross section of a mounting portion of the hinge.
Figure 5:
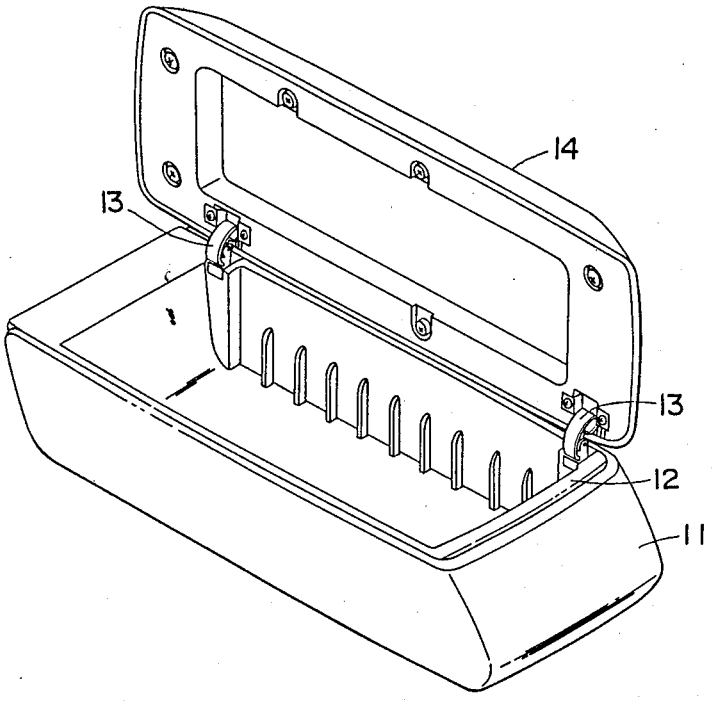
FIG. 5 is a perspective view of a console box on which the hinge is mounted.

FIG. 5 shows a synthetic resin console box. Fitted in an outer box 11 is an inner box 12 for accommodating cassette tapes. Mounted on one side of the inner box 12 through a pair of hinges 13 of this invention is a cover 14 that can be opened and closed. The inner box 12, as shown in FIGS. 1 and 2, is formed integral with a pair of projecting bosses 15 and a rib 16 between the bosses 15. In FIG. 2, a rotating member 24 is mounted on one end of a base 21 of the hinge 13 through a first link arm 22 and a second link arm 23 so that the rotating member 24 can be opened and closed. The rotating member 24 is held open or closed by a leaf spring 25. The first and second link arms 22, 23 are formed of a sheet metal, as with the leaf spring 25.

The base 21, as shown in FIG. 1, consists of a pair of side plate portions 31 at both sides of the protruding bosses 15 of the inner box 12 on which the hinge 13 is mounted; a connecting plate portion 32 integrally formed with, and provided between, the link arm mounting sides of the pair of the side plate portions 31; and screw support plate portions 33 bent inwardly from the pair of side plate portions 31 so that they face the protruding bosses 15, the screw support plate portions 33 being joined together to form a member shaped in cross section like a letter U. The base 21 is formed out of a single piece of sheet metal by bending and shaping and has screw insertion holes 34 at the joint between the screw support plate portions 33.

Figure 3:
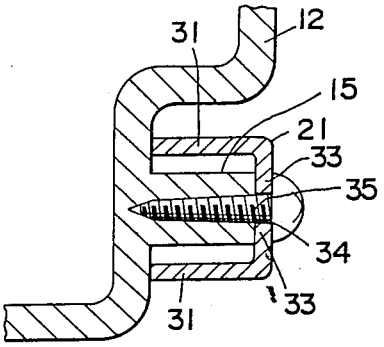
FIG. 3 is a cross section taken along the line III—III of FIG. 2.

As shown in FIG. 3, the U-shaped portion of the base 21 consisting of the pair of side plate portions 31 and the screw support plate portions 33 is fitted over the bosses 15. Tapping screws 35 inserted from outside into a pair of screw insertion holes 34 are screwed into small holes in the bosses 15 to securely fix the two screw support plate portions 33 on each side to the bosses 15. The screw insertion holes 34 are vertically elongate holes, so that by loosening the tapping screws 35 the base 21 can be moved vertically for proper adjustment.

The rotating member 24, as shown in FIG. 1, has a recessed body 41 which has mounting plate portions 42 formed integral therewith and projecting outwardly from both sides of the body 41. The mounting plate portions 42 each have a screw insertion hole 43.

As shown in FIG. 2, the first link arm 22 has its rolled cylinder portion 53 at one end rotatably engaged with a pin 52, which is inserted into a pair of projecting portions 51 erected on the upper part of the pair of the side plate portions 31 of the base 21. Another rolled cylinder portion 55 at the other end of the link arm 22 is rotatably engaged with a pin 54 inserted into the recessed body 41 of the rotating member 24. The second link arm 23 has its rolled cylinder portion 57 at one end rotatably engaged with a pin 56 inserted into the upper parts of the pair of the side plate portions 31 of the base 21. Another rolled cylinder portion 60 of the second link arm 23 at the other end is rotatably engaged with a pin 59, which is inserted into a pair of projecting portions 58 of the recessed body 41 of the rotating member 24.

The leaf spring 25, as shown in FIG. 2, has its bent portion 62 at one end engaged with an engagement plate portion 61, which is formed integral with, and provided between, the projecting portions 51 on each side of the base 21. A curved portion 63 of the leaf spring 25 on the other end is engaged with the upper rolled cylinder portion 55 of the first link arm 22.

Figure 4:
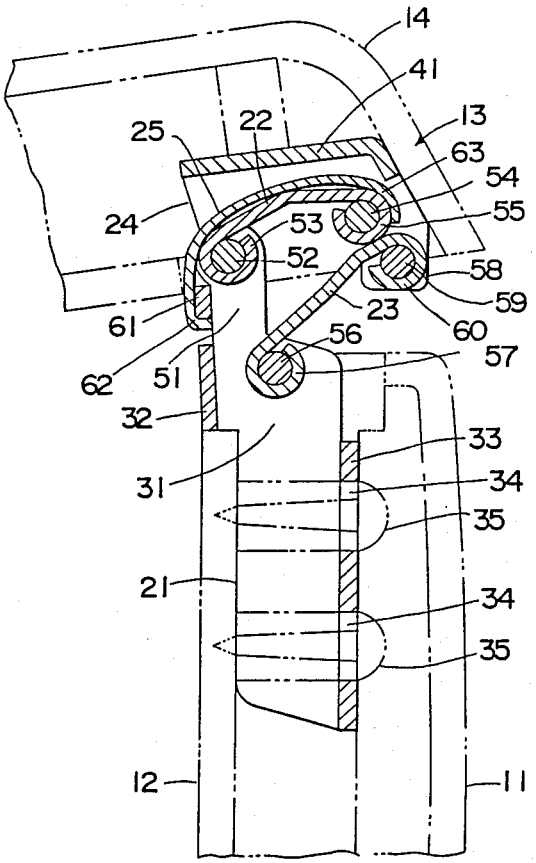
FIG. 4 is a cross section showing the hinge in a closed condition.

Since this leaf spring 25 acts on the first link arm to shorten the distance between its ends, the pin 54 is urged to rotate clockwise in FIG. 2 about the pin 52, i.e., to move toward the pin 56. Therefore, when the pin 59 is located on the left side of a line connecting the pin 54 and the pin 56, the pin 59 is urged to move toward the left. When it is on the right side of the line as shown in FIG. 4, the pin 59 is urged to move to right. In other words, the direction of rotation of the rotating member 24 is determined according to on which side of the line connecting the pin 54 and the pin 56 the pin 59 is located. Thus, when the cover 14 is in the open state, as shown in FIG. 2, the cover is supported in this condition with the upper rolled cylinder portion 60 of the second link arm 23 engaged with the first link arm 22. When, as shown in FIG. 4, the cover 14 is in the closed state, it is held closed with the cover 14 engaged with the edges of the outer box 11 and the inner box 12.

The base 21, as described above, has the pair of side plate portions 31 bent from both sides of the connecting plate portion 32. The screw support plate portions 33 are bent from the pair of the side plate portions 31 and the two screw support plate portions 33 are joined together so that the base 21 is continuous in structure. The two screw support plate portions 33 are secured to the bosses 15 at the joint part by the common tapping screws 35, so that the base 21 has a large structural strength and the two screws 35 provide as secure fixing as do four screws.

The hinge according to this invention may be summarized as follows.

The hinge base forming one of two mating members of a hinge consists of: a pair of side plate portions fitted over projections of a member on which the hinge is mounted; a connecting plate portion formed integral with, and provided between, the link arm mounting sides of the pair of the side plate portions; and screw support plate portions bent inwardly from the pair of the side plate portions so that they face the projections of the member on which the hinge is mounted, the screw support plate portions being joined together so that the side plate portions and the screw support plate portions together shape like a letter U. These portions of the base are formed out of a single piece of sheet metal by bending and shaping. Since the screw support plate portions are formed with screw insertion holes at the joint part, it is possible to fix the base using the screw support plate portions—which are inwardly bent and have small mounting widths—to small mounting portions, such as bosses, of the member on which the hinge is to be mounted. Further, since the two screw support plate portions are joined together, the base has a good appearance and the joint part of the screw support plate portions can be fixed to the mounting portions with one-half the number of screws that would be required with conventional techniques, thus reducing the time for a screw fixing process. Moreover, since the connecting plate portion, the pair of the side plate portions and the screw support plate portions are formed continuous, the base has an improved structural strength.

What is claimed is:

1. A hinge (13) having a hinge base (21) and a pair of link arms (22,23) thereon for rotatably securing a rotating member (24) to another member (12) which has a projection (15) on which said hinge base (21) is to be mounted and secured by at least one screw (35), said projection (15) having a screw-receiving surface and a pair of laterally spaced apart side surfaces;

said hinge base (21) being formed of a bent and shaped single piece of sheet metal and having top, bottom front, rear and opposite lateral sides and comprising;

a pair of side plate portions (31) disposed at said opposite lateral sides and spaced apart from each other for receiving said projection therebetween;

a connecting plate portion (32) integral with and extending between said side plate portions (31) at said front;

and screw support plate portions (33) bent inwardly from and integral with said side plate portions (31) at said rear so as to confront said screw-receiving surface of said projection (15), said screw support plate portions (33) and said side plate portions (31) cooperating to define a U-shaped structure having a cavity for receiving said projection (15), the inwardly bent screw support plate portions (33) having confronting edges defining a joint therebetween and being provided with at least one screw insertion hole (34) therethrough which extends through said screw support plate portions (33) and through said joint.

2. A hinge (13) according to claim 1 including a screw (35) extending through said screw insertion hole (34) for insertion into said screw-receiving surface of said projection (15).

3. A hinge (13) according to claim 1 further having a spring (25) for releasably maintaining said rotating member (24) in closed or open condition relative to said another member (12).

4. A hinge (13) according to claim 1 wherein said inwardly bent screw support plate portions (33) are provided with a plurality of screw insertion holes (34) therethrough, each of which holes (34) extends through said screw support plate portions (33) and through said joint.

5. A hinge (13) according to claim 4 for mounting on a plurality of projections (15) on said another member (12).

* * * * *